US009396618B2

(12) United States Patent
Weston et al.

(10) Patent No.: US 9,396,618 B2
(45) Date of Patent: Jul. 19, 2016

(54) INTERACTIVE PLAY CENTER

(71) Applicant: Whitewater West Industries Ltd., Richmond (CA)

(72) Inventors: Mark Weston, Wakefield, RI (US); Denise Weston, Wakefield, RI (US); Rick Briggs, Springfield, IL (US)

(73) Assignee: Whitewater West Industries Ltd., Richmond, BC (CA)

( * ) Notice: Subject to any disclaimer, the term of this patent is extended or adjusted under 35 U.S.C. 154(b) by 0 days.

(21) Appl. No.: 14/502,812

(22) Filed: Sep. 30, 2014

(65) Prior Publication Data

US 2015/0090242 A1 Apr. 2, 2015

Related U.S. Application Data

(60) Provisional application No. 61/884,876, filed on Sep. 30, 2013.

(51) Int. Cl.

| | |
|---|---|
| ***A63G 21/00*** | (2006.01) |
| ***G07F 17/38*** | (2006.01) |
| ***G07F 17/32*** | (2006.01) |

(52) U.S. Cl.

CPC ..... *G07F 17/38* (2013.01); *G07F 17/323* (2013.01); *G07F 17/3206* (2013.01); *G07F 17/3218* (2013.01); *G07F 17/3227* (2013.01); *G07F 17/3239* (2013.01)

(58) Field of Classification Search

CPC ..... A63G 21/00; A63G 21/18; A63H 23/00; A63H 23/10; A63F 13/00; A63F 13/12

USPC ..... 472/13, 117, 128, 43; 273/317, 459; 124/41.1, 79

See application file for complete search history.

(56) References Cited

U.S. PATENT DOCUMENTS

| | | | | | |
|---|---|---|---|---|---|
| 5,673,918 | A * | 10/1997 | Bigari | A63B 9/00 | 134/195 |
| 5,785,592 | A * | 7/1998 | Jacobsen | A63F 9/0291 | 273/349 |
| 5,853,332 | A * | 12/1998 | Briggs | A63B 9/00 | 472/128 |
| 6,186,902 | B1 * | 2/2001 | Briggs | A63G 21/18 | 472/117 |
| 7,524,246 | B2 * | 4/2009 | Briggs | A63F 7/2472 | 273/440 |
| 7,749,089 | B1 * | 7/2010 | Briggs | A63F 13/12 | 446/484 |
| 8,021,236 | B2 * | 9/2011 | Bloom | A63F 9/02 | 124/41.1 |
| 8,821,304 | B2 * | 9/2014 | Ensing | A63G 21/18 | 472/128 |

* cited by examiner

*Primary Examiner* — Kien Nguyen
(74) *Attorney, Agent, or Firm* — Greenberg Traurig

(57) ABSTRACT

An entertainment venue, amusement attraction, or interactive play center configured to provide a variety of activities for users. The attraction may include blaster cannons, sorting stations, fountain components, registration stations, video monitors, targets, and other interactive elements. Several of these components may receive and/or propel elements (such as foam balls, water, light or lasers, etc.) and accumulate points for users based upon this activity. A registration and tracking system can keep track of specific users and their activities for the purpose of generating or compiling statistics or generating a score for the users. A mobile application associated with the interactive play center may be used during play to indicate additional information or features about the amusement attraction or to allow for continued entertainment by users even after they have left the entertainment venue or interactive play center. This may be conveyed via augmented reality or other visual/audible notification.

20 Claims, 9 Drawing Sheets

INTERACTIVE PLAY CENTER

CROSS REFERENCE TO RELATED APPLICATIONS

This application claims the benefit of U.S. Provisional Patent Application Ser. No. 61/884,876, filed on Sep. 30, 2013, entitled "FUSION FACTORY INTERACTIVE PLAY CENTER," which is hereby incorporated by reference in its entirety.

BACKGROUND

1. Field of the Invention

The present invention relates to interactive play centers. More particularly, the present invention relates to an interactive play center interactive play center.

2. Description of the Related Art

The way kids and adults play has evolved dramatically over the last decade. Video games, computer games, mobile applications, casual games, Facebook, online worlds, and dozens of other communication connections have made personal, customized experiences and gaming a part of most everyone's everyday life. In spite of this, many attractions at amusement parks or other family entertainment venues separate individuals, whether it is due to height requirements, seating limitations, or otherwise single-focus experiences that may not appeal to everyone. To accommodate the influx of individuals interested in these gaming experiences, new interactive play centers are desired that allow for a variety of play manners. Particularly as technology has increased in prevalence for children and young adults, (e.g., cell phones, tablets, video game consoles, computer entertainment, etc.), new entertainment venues or interactive play centers are needed to help lower the barrier that is increasingly wedged between users of these devices (e.g., children or young adults) and those who are less familiar with their capabilities or uses (e.g., parents or older adults). Thus, an interactive play center that allows for different play styles along with different types of physical and mental activities to keep a diversity of patrons interested is desired.

SUMMARY

The present invention is related to an interactive play center accommodating a variety of different play styles or activities. In one embodiment, an interactive play center may include a receptacle configured to receive an element, a blaster component configured to emit an object based upon receipt of the element by the receptacle, a target configured to be engaged by the object emitted from the blaster component, a fountain component in communication with the receptacle, the fountain component configured to receive the element and eject the element, and a processor configured to modify a score based upon the object engaging with the target.

In another embodiment, an interactive play center may include a first receptacle configured to receive an element, the first receptacle associated with a first characteristic, a second receptacle configured to receive the element, the second receptacle associated with a second characteristic, a blaster component configured to emit an object based upon receipt of the element by the first receptacle or the second receptacle, a target configured to be engaged by the object emitted from the blaster component, and a processor configured to modify a score if the object engages the target.

In still another embodiment, an interactive play center may include a receptacle configured to receive an element, a first interactive component disposed at a first location, a second interactive component disposed at a second location, a fountain component configured to receive the element after receipt of the element by the receptacle, the fountain component configured to eject the element via pressurized air, and a processor configured to increase a score by a first value based upon interaction with the first interactive component and increase the score by a second value based upon interaction with the second interactive component.

In various embodiments, an interactive play center may provide a combination of activities to a user, such as, a blaster cannon configured to receive elements and capable of firing a light upon receipt of a predetermined number of the elements, a target configured to be hit by the light fired from the blaster cannon, a sorting station configured to receive the elements, a processor configured to generate a score for the user based upon the user interacting with the blaster cannon or the sorting station, a jockey system configured to communicate with the user, a video screen configured to display the score generated for the user, and a mobile application configured to display game information relating to the interactive play center. The blaster cannon of the interactive play center may be a laser gun such that users can participate in laser-tag activities where they fire upon any or all of the following: users wearing clothing or articles that act as laser targets, stationary targets mounted around the play area, and moving targets that automatically move around the play area (e.g., on moving tracks or swinging pendulums). The mobile application of the interactive play center is configured to be executed on a smart phone or tablet device such that users can continue to engage in the entertainment activities either when not physically present at the play area and/or may use their mobile devices while at the play area for various gaming purposes (e.g., identification of equipment in the play area that yields bonus points, etc.)

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
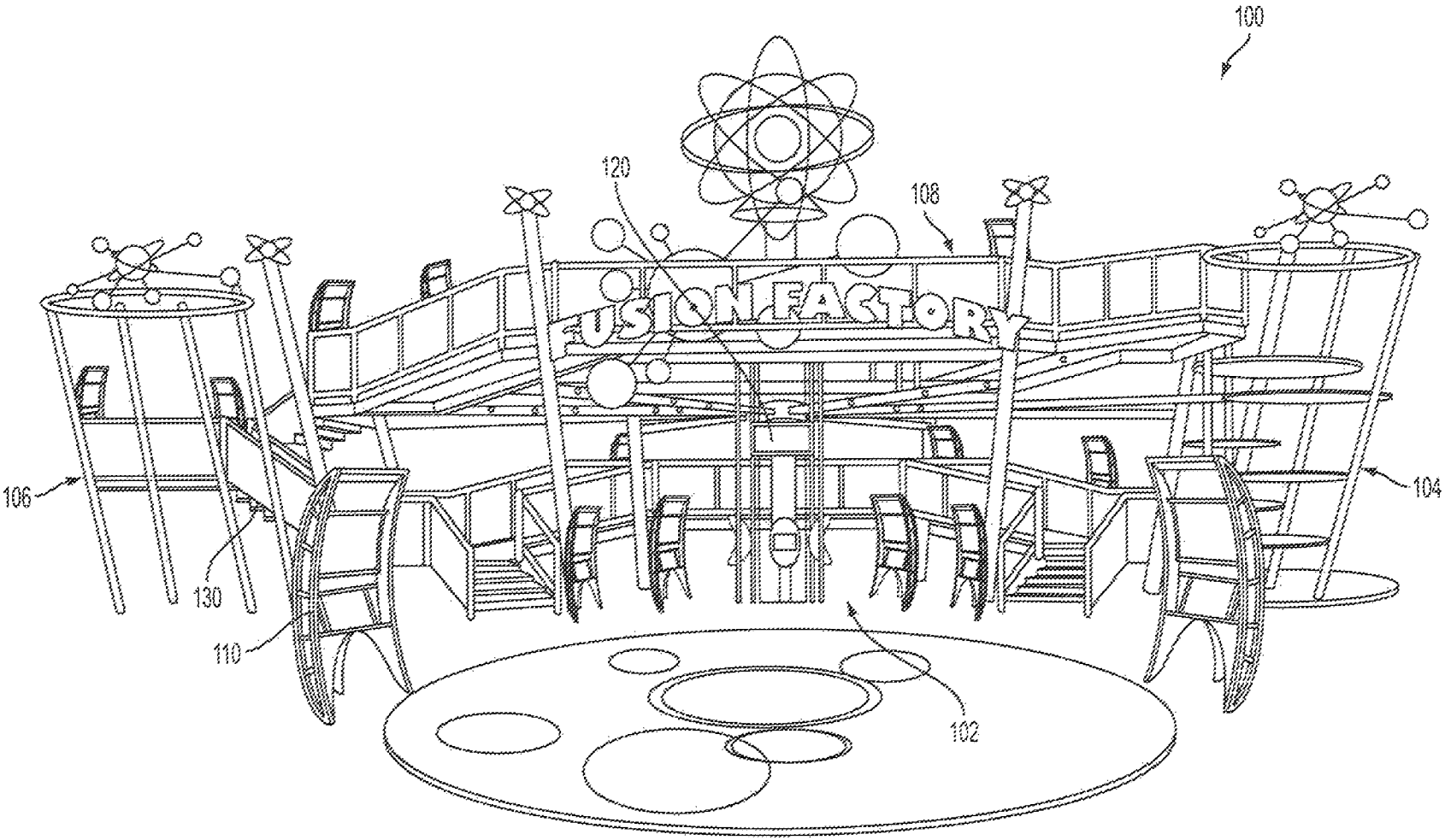
FIG. 1 shows a front view of an interactive play center combining a variety of gameplay elements or activities according to one embodiment of the present invention.

Turning first to FIG. 1, an entertainment venue or interactive play center 100 is shown from a front view that incorporates a fusion, combination, or other variety of play elements or activities for participating users, as discussed herein. The entertainment venue or interactive play center 100 may be located or configured for use at an amusement park, resort, water park, or other entertainment center or area. For example, the play elements or activities incorporated within the interactive play center 100 may include one or more of blasting, dumping, vacuuming, or shooting balls or other elements (e.g., made of foam or other soft material), as discussed in greater detail herein. In another example, the interactive play center 100 may include laser blasters with targets and scoring mechanisms, with or without integrated laser tag features or technology (e.g., wearable targets and/or mobile laser blasters that can be carried around by users), as discussed in greater detail herein. In yet another example, the interactive play center 100 may be designed to be wet in nature, such as a water park attraction, that uses blasts of water to entertain users (e.g., blaster components, as discussed in greater detail herein, may shoot streams of water at targets and/or other users).

In certain embodiments, the interactive play center 100 may be provided with a story or background setting or theme in order to provide additional immersion to its participants and utilize game play that is tailored to the story or background setting, as discussed in greater detail herein. In yet another example, cranks, pulleys, or other hands-on interactive play elements (such as buttons, knobs, etc.) may perform a variety of functions in the interactive play center 100, as discussed in greater detail herein. Mobile devices and/or their corresponding mobile applications may be integrated into the game play elements or activities of the interactive play center 100.

The interactive play center 100 combines any of a variety of elements or activities for use, including foam balls, laser guns, phones, cameras, video screens, game play, targets, story, slides, and/or climbs as discussed in greater detail below. In one embodiment, foam ball play may include a foam ball playground or arena 102 and one or more platforms or levels (104, 106, 108) (e.g., connected to one another via one or more staircases or ramps 130) where users can gather balls, blast or shoot them at other users, and/or load them into dumping buckets or other receiving equipment at locations throughout the interactive play center 100. In another embodiment, laser gun play may include laser guns (e.g., mounted guns and/or guns that are portable and may be carried around by users) located at any or all of the arena 102 and/or platforms or levels (104, 106, 108) that may not fire until they are properly "charged" up by the users, for example by inserting elements (e.g., foam balls). In this manner, elements that are disposed around the play area and/or used for a variety of gaming experiences can also be used to facilitate a game of laser tag or laser target play. In conjunction with the ball play or laser play, or as part of a separate embodiment, a scoring system or accumulation of points may be provided for performing various activities of the interactive play center 100.

For example, users may choose to register (e.g., at a registration/upgrade station 110, discussed in greater detail herein), create, or otherwise setup a fictional or real game name and score points each time they engage in a predetermined activity. These activities may include shooting balls at targets or other players, placing balls into predefined sorting or reception machines, etc. Such registration and/or tracking of users while they perform activities may be done automatically, for example, through the touch of a finger through biometric scanning (e.g., facial recognition, etc.), through entering of a code unique to that user (e.g., previously provided to that user via a mobile application, discussed in greater detail herein, or concurrently generated and provided to the user at the time of registration at the amusement location, through the swipe of an RFID tag that is worn or otherwise associated by a user, retina scanning, etc. In another example, a device held or otherwise carried by a user may be sensed, via RF or otherwise, in order to track the device and, thus, its particular user, throughout the amusement attraction. In one embodiment, registration for a game may utilize a "fast pass" system that requires a user to only touch or swipe in order to create a game name to facilitate quicker and/or easier access to the entertainment. As is discussed in greater detail herein for the various activities possible for users to engage with, such tracking allows for a score or other unique statistics to be accumulated or generated for a specific user, based on the tracking of that user's activities.

Scores for the various users may be stored by a computerized or electronic system (e.g., including a processor and connected memory) associated with the interactive play center 100 and may be displayed upon video monitors or scoreboards (e.g., monitor 120) disposed at one or more locations around the play arena 102 and/or platforms of levels (104, 106, 108) and/or at the front entrance to the interactive play center 100. In one embodiment, score or other data relating to the users of the interactive play center 100 may be automatically erased from the system at predetermined times (e.g., at the end of a business day, at the end of a particular round or time for a game, etc.). In another embodiment, score or other data relating to the users of the interactive play center 100 may be kept or stored, either upon election by a particular user, or otherwise, in order to have it remain stored for future return play and/or forwarded to an online account associated with the user. For example, when a user signs in at the registration/upgrade station 110, the interactive play center 100 may be configured to forward various game information, such as the user's score, time played, relationship to other users playing concurrently, etc.). Retail items (e.g., toys) may be sold to users of the interactive play center 100 and include embedded technology (e.g., a processor and a memory) that is configured to store the user's points or other statistics relating to the experience at the interactive play center 100. In another embodiment, the user may be able to download an application to a device (e.g., a mobile device such as a cell/smartphone, tablet, laptop) that is associated with the user's account and the application or device may be configured to store the user's points or other statistics.

In another embodiment, the interactive play center 100 permits personalization and/or immersion features for a user. For example, after a user has played and/or earned enough points by participating in activities in or related to the interactive play center 100, the user can choose to upgrade their registration account. This upgrading may occur, for example, at the registration/upgrade station 110, at a discrete or separate upgrade station at the interactive play center 100, and/or by accessing their account online (e.g., via a web page on the Internet or via the application). The discrete or separate upgrade station may act as a status symbol for players that have earned enough points to access them and/or can aid in allowing frequent or high-scoring players with fast access to the interactive play center 100. For example, users that are able to access the upgrade station may bypass the "fast pass" or registration/upgrade station 110 that may otherwise be required or frequented by other, more casual users whom are not capable of accessing the upgrade station.

In some embodiments, users may also pre-register and enter information for their accounts using a computer or mobile application or webpage. The user can personalize their play, for example, by associating a photograph with their score or account, choosing a predefined avatar for their account, adding information, such as user profile data with their name, location, etc., to their account, and so forth. In some embodiments, personal information may not be collected or associated with the account for security reasons.

The interactive play center 100 may incorporate a jockey system that is capable of keeping track of the action of each user participating in the interactive play center 100 through a database stored in memory and provide a series of announcements (e.g., spoken, audible, or displayed) to the users of certain events that occur or are about to occur. These announcements may be tailored to a specific theme that is incorporated into the interactive play center 100. For example, in reference to a story or background theme, discussed in greater detail below, the jockey system may announce when "Orbs" are to be assisted and/or when "Dark Orbs" are to be hindered by performing various activities. The jockey system may operate automatically according to programmed instructions in order to help facilitate movement of users around the interactive play center 100 and keep users actively involved with various interactive elements. The jockey system may additionally, or alternatively, be controlled by staff of the interactive play center 100, for example, via a touch screen interface, which allows the staff to direct the action or users towards certain events or activities.

In one embodiment of the jockey system, a computerized system may keep track of users, user scores, and/or activities or status of activities being performed by users within the play area. For example, if one user is getting a particularly high score, the jockey system may announce the player name, score, and/or location within the play area that the user is currently participating, in order to encourage other players to fire (e.g., lasers) at the player or otherwise make attempts to close the score gap between themselves and the named player. In another embodiment of the jockey system, various aspects of the game being played by users may be announced (e.g., if "Dark Orbs" have shown up and need to be dealt with in conjunction with a story or background theme, as discussed in greater detail herein, if a piece of equipment will currently be worth bonus points, etc.).

In still another embodiment of the jockey system, human staff, rather than or in conjunction with an automated computer system, may cause the jockey system and/or the game itself to influence player activity. For example, if staff notices that a particular portion of the play area is not seeing much use, the staff may cause the game mechanics to incentivize play in those areas (e.g., by making such equipment in the areas award extra points) and cause the jockey system to announce such changes in the game mechanics. In this way the jockey system can dynamically adjust to user activities in the play area to increase the excitement or fun to the participants. Any of a variety of manners of interacting with the jockey system or game mechanics may be used (e.g., touch-screen controls, etc.).

Figure 2B:
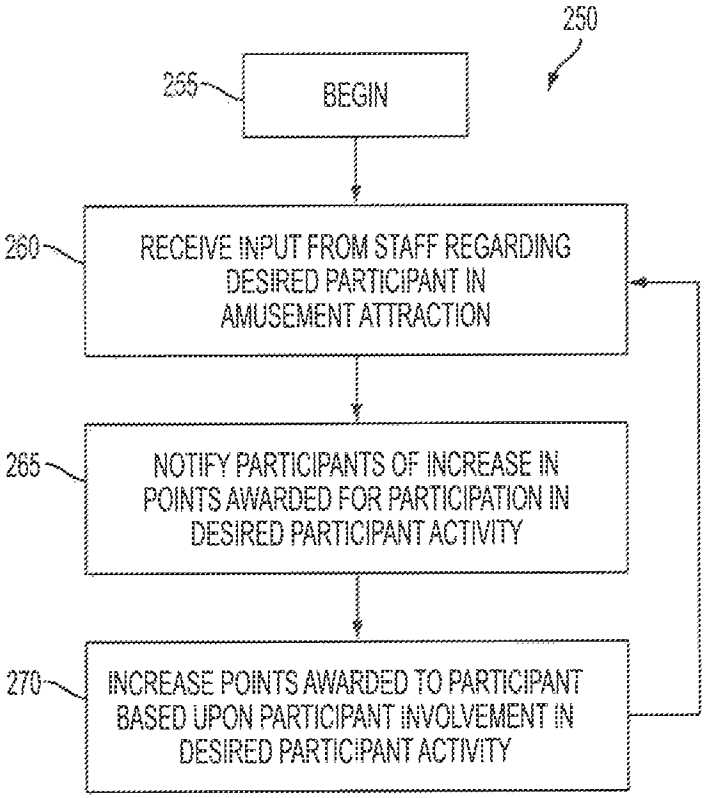
FIG. 2B shows a flowchart for operation of a manual jockey system for an interactive play center according to one embodiment of the present invention.
Figure 2A:
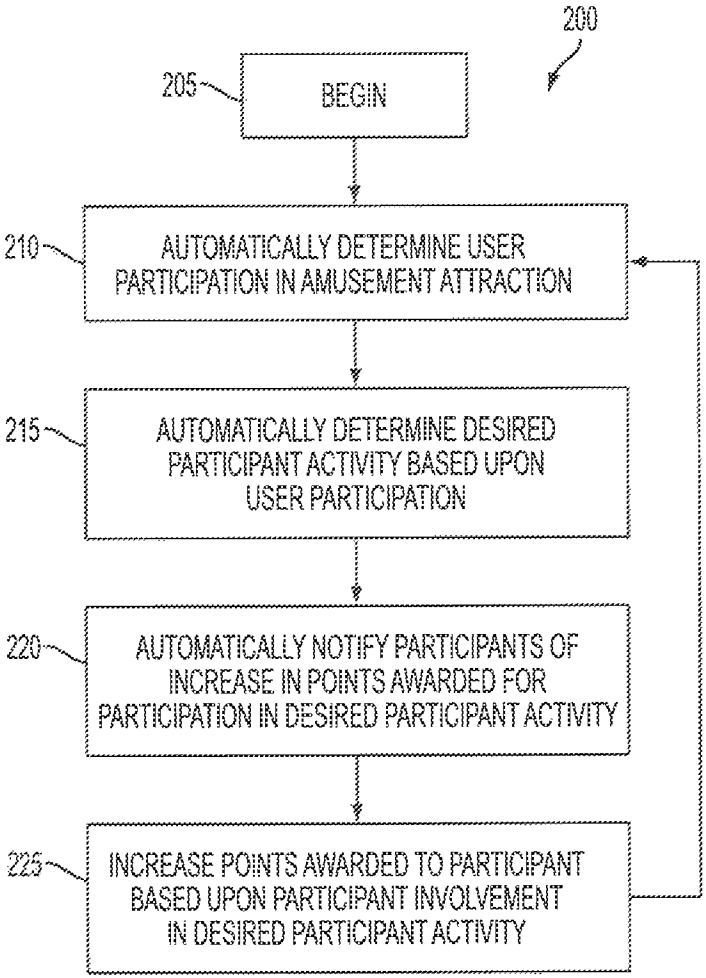
FIG. 2A shows a flowchart for operation of an automatic jockey system for an interactive play center according to one embodiment of the present invention.

FIG. 2A shows a flowchart for operation of an automatic jockey system 200 for an interactive play center. The interactive play center may be the same as or similar to those previously discussed. Operation for the automatic jockey system 200 begins at step 205, which may be when a particular game for the interactive play center begins. Operation continues to step 210 where a processor for implementing the automatic jockey system 210 automatically determines user participation in the amusement attraction or interactive play center. This may occur by way of monitoring which activities are being used by the participants, for example via sensing when elements (such as foam balls, etc., as previously discussed) are being inserted by users into particular pieces of equipment.

Operation then continues to step 215 where the automatic jockey system 200 automatically determines desired participant activity based upon the user participation determined in step 210. For example, if the processor determines that users are using particular pieces of equipment more frequently than others, the processor implementing the automatic jockey system 200 may determine that the less-frequently used equipment is desirable for increased participation. Operation then continues to step 220 where the automatic jockey system 200 automatically notifies participants of an increase in points awarded for participation in the desired participant activity determined in step 215. In an alternative embodiment, any of a number of other encouragements may be provided in order to notify participants that play in the desired participant activity is encouraged.

Operation then continues to step 225 where the automatic jockey system 200 increases the points awarded to participants based upon the participant involvement in the desired participant activity. For example, this may be accomplished by causing a higher score accumulation for elements inserted into equipment identified as desirable and notified to the participants as desirable in steps 215 and 220. Operation may then repeat back to step 210 in order to continuously encourage participation at various pieces of equipment (e.g., lesser used equipment). In this fashion, the automatic jockey system 200 may be able to better utilize an entire play arena and encourage participant movement to various pieces of available equipment, without requiring intervention or monitoring by staff of the interactive play center or amusement attraction.

In contrast to FIG. 2A, FIG. 2B shows a flowchart for operation of a manual jockey system 250 for an interactive play center. The interactive play center may be the same as or similar to those previously discussed. Operation for the manual jockey system 250 begins at step 255, which may be when a particular game for the interactive play center begins. Operation continues to step 260 where a processor for implementing the manual jockey system 260 receives input from a user (e.g., a staff member for the amusement attraction) regarding a particular participant activity in the amusement attraction or interactive play center than would be desired. This may occur by way of a computer or input panel that is connected with the processor and allows the staff to input pieces of equipment or areas of the amusement attraction which is desired to be be encouraged for use by the participants.

Operation then continues to step 265 where the manual jockey system 250 notifies participants of an increase in points awarded for participation in the desired participant activity determined in step 215. In an alternative embodiment, any of a number of other encouragements may be provided in order to notify participants that play in the desired participant activity is encouraged. Operation then continues to step 270 where the manual jockey system 250 increases the points awarded to participants based upon the participant involvement in the desired participant activity. For example, this may be accomplished by causing a higher score accumulation for elements inserted into equipment identified as desirable and notified to the participants as desirable in steps 260 and 265. Operation may then repeat back to step 260 in order to await additional input for encouraging participation at various pieces of equipment (e.g., lesser used equipment). In this fashion, the manual jockey system 250, in conjunction with staff monitoring, may be able to better utilize an entire play arena and encourage participant movement to various pieces of available equipment. In certain embodiments, a combination of features or operation described from FIGS. 2A and 2B may be used (e.g., both automatic and manual operation for a jockey system).

Figure 3:
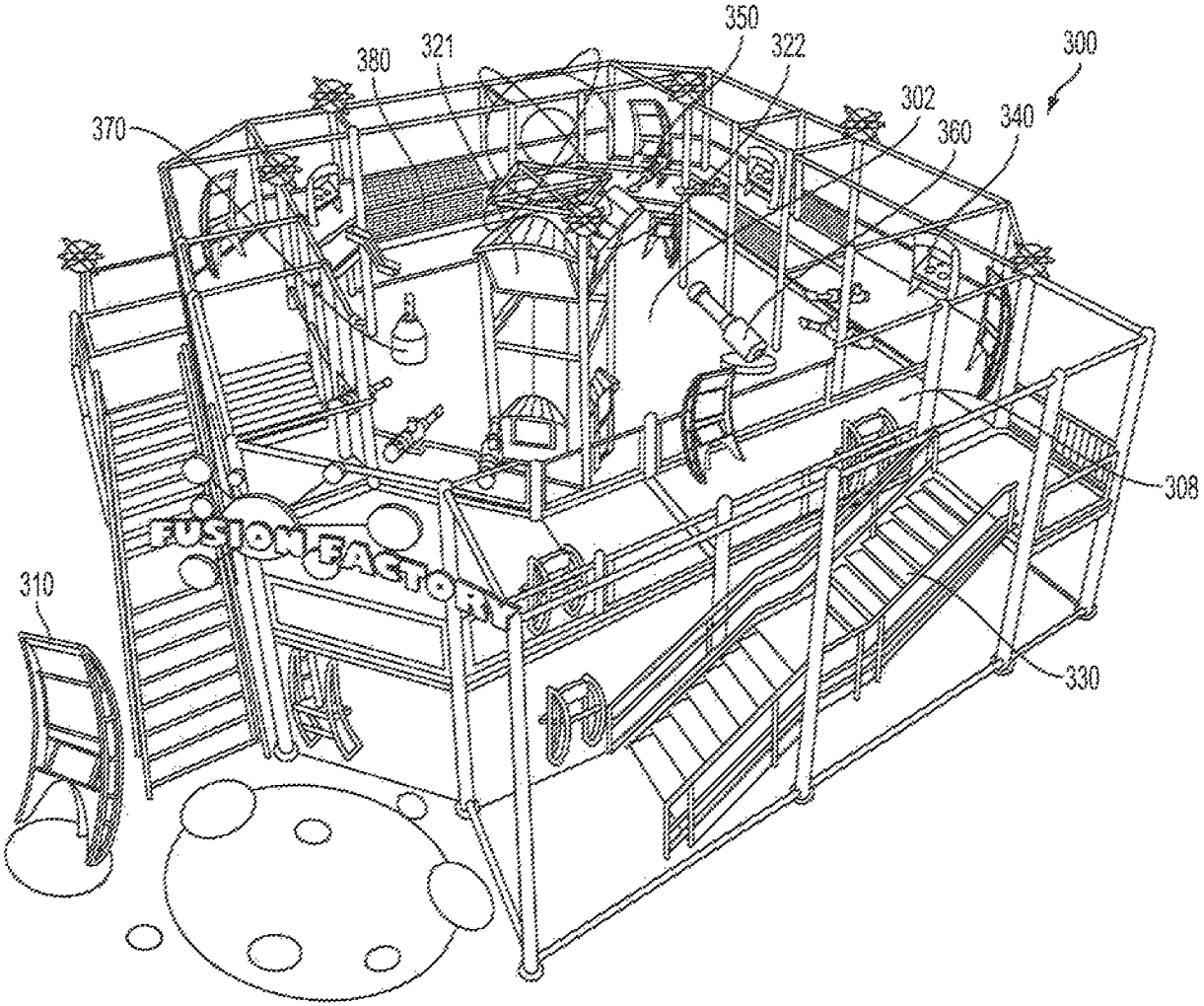
FIG. 3 shows a perspective view of an interactive play center combining a variety of gameplay elements or activities according to one embodiment of the present invention.

FIG. 3 shows a perspective view of an entertainment venue or interactive play center 300. The interactive play center 300 may include features that are the same as or similar to those previously discussed. For example, one or more monitors or displays (321, 322) may be disposed in the interactive play center 300 to communicate various information to players participating in or observing the activity of the interactive play center 300 (e.g., user scores, game instructions, videos relating to a game or theme of the interactive play center 300, etc.), the same as or similar to those previously discussed. A play area or arena 302 and/or one or more of platforms, levels, or walkways 308 that may or may not be connected by one or more elevating surfaces 330 (e.g., stairs, ramps, etc.) may be disposed as part of the interactive play center 300 that contain various interactive elements (e.g., ball and/or laser shooters (350, 360, 370), receptacle or sorting stations 340, etc.) that a user may participate with. Certain portions or segments of the platforms, levels, or walkways 308 may be made of a netting or moveable material 380 (cloth mesh, rope, etc.) for providing additional enjoyment or obstacles to users of the interactive play center 300. Similar to previous discussions, one or more registration/upgrade stations 310 may be disposed as part of the interactive play center 300, for example adjacent to an entrance of the interactive play center 300.

Figure 4:
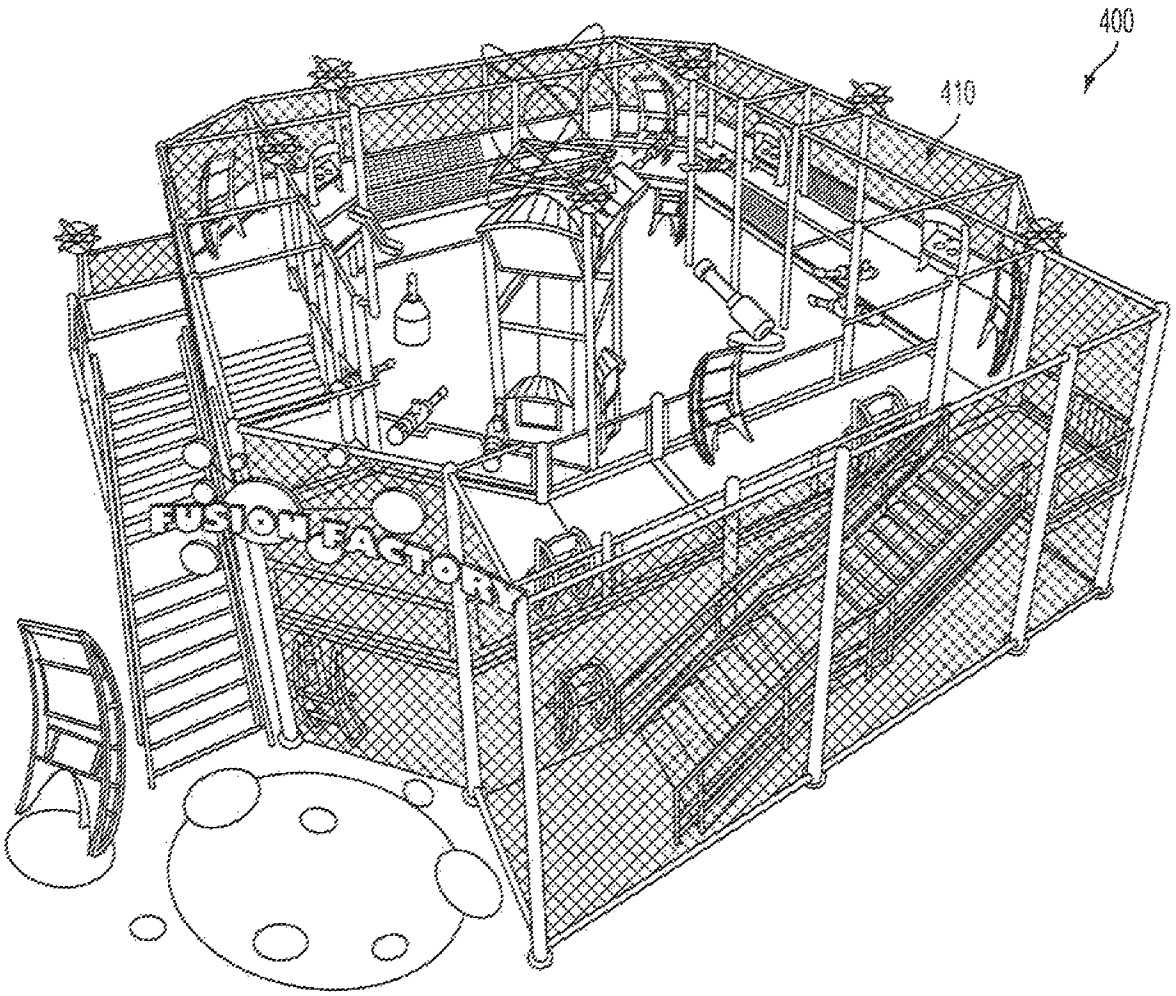
FIG. 4 shows a perspective view of an interactive play center combining a variety of gameplay elements or activities according to one embodiment of the present invention.

FIG. 4 shows a perspective view of an entertainment venue or interactive play center 400. The interactive play center 400 may include features that are the same as or similar to those previously discussed. The interactive play center 400 includes a netting or other barrier 410 around sonic or all of the exterior of the play space of the interactive play center 400 in order to help maintain users and/or elements (e.g., foam balls) within the play space. In one embodiment, the interactive play center 400 may have dimensions of 59 feet long by 46 feet wide by 25 feet high with have a capacity of approximately 190 simultaneous users.

Figure 5:
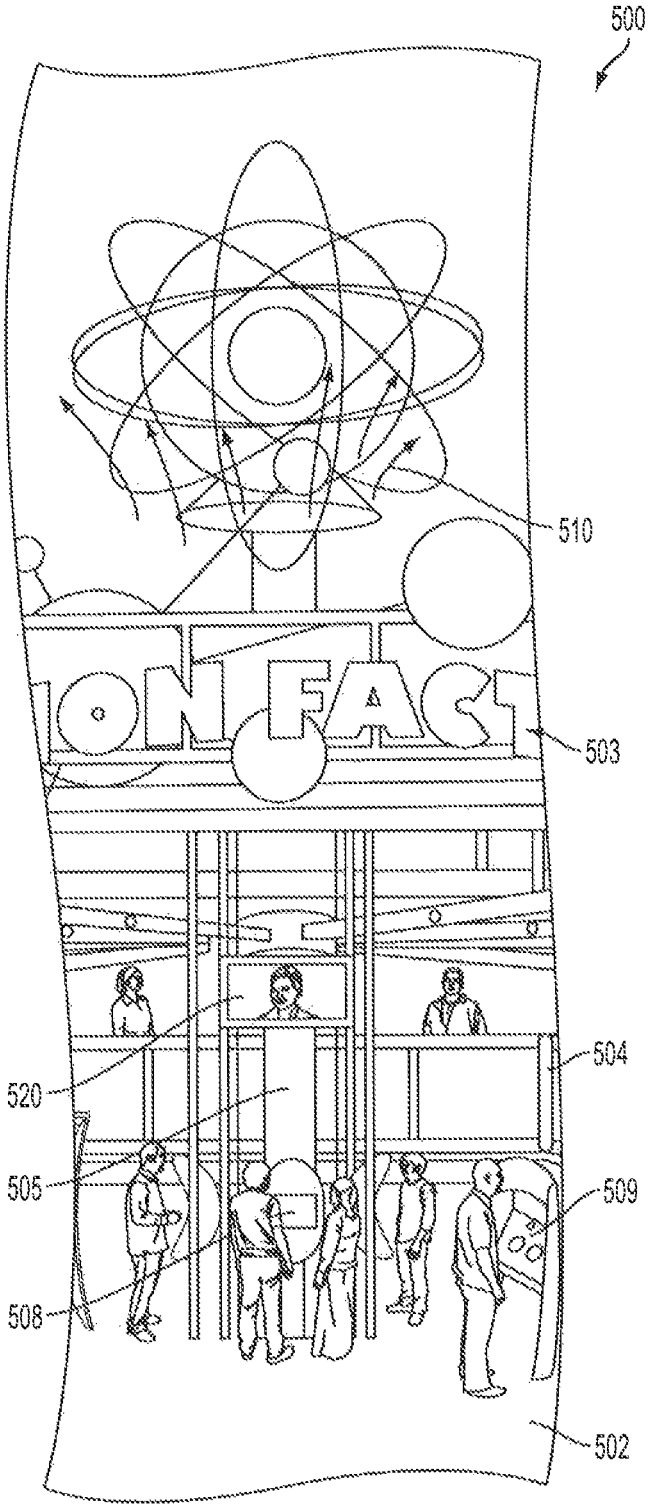
FIG. 5 shows a side view of a fountain component of an interactive play center according to one embodiment of the present invention.

FIG. 5 shows a side view of a fountain component 500. The fountain component 500 may be located or used in an entertainment venue or interactive play center, for example, the same as or similar to those previously discussed. The fountain component 500 may include a column 505 (e.g., hollow) that extends from a lower floor or level 502 and part one or more upper floors or levels (503, 504). Users in the interactive play center (e.g., on the lower floor or level 502 and/or one or more upper floors or levels (503, 504)) may insert 508 elements (e.g., foam balls) into the fountain component 500 or into stations 509 connected and/or adjacent to the fountain component 500 (such as blaster components, sorting components, etc. the same as or similar to those previously discussed) such that the elements are transported or propelled 510 via the column 505 to one or more of the lower floor or level 502 and/or upper floors or levels (503, 504), for example, by way of flowing or pressurized fluid, such as air or water. Alternative embodiments may propel the elements in alternative manners (e.g., hydraulic or mechanical "popping" of the elements out of the fountain component 500, such as by a moving platform that makes contact with the elements. In this manner, other equipment that is located on one or more of the lower floor or level 502 and/or upper floors or levels (503, 504) that uses the elements may have their supply replenished and easily accessible by users on such lower floor or level 502 and/or upper floors or levels (503, 504), for example, particularly if those elements had previously been fired or otherwise dropped down to the lower floor or level 502.

The movement of the elements within the fountain component 500 may be visible to users (e.g., through the use of transparent or translucent materials). In one embodiment, this may be accommodated through the use of an acrylic or plastic tube. In another embodiment, vertical lighting strips, tracks, or strobes may be used to symbolize or correspond to upward movement of elements, for example, such lighting occurring simultaneous with an element being sucked in and up the fountain component 500. Various other effect lighting may also be used with the fountain component 500, such as pulsing lamps or lights. Audio effects such as a low level humming or throbbing sound may also be associated with the fountain component 500 to give it a feeling of electric power and/or a beating heart or soul.

The fountain component 500 may be located substantially at a center of the play area of the interactive play center. One or more video screens 520 may be positioned on, near or adjacent to the fountain component 500 and aid in encouraging users to participate in certain activities, for example, activities that correspond to a story or theme of the interactive play center. For example, as discussed in greater detail below, a story or theme of the interactive play center may involve colored "Orbs" asking users to perform activities to charge a Fusion Factory. One or more of the video screens may display a colored "Orb" and users who place an element (e.g., a foam ball) into the fountain component 500 and/or stations connected or adjacent to the fountain component 500 having the same color as the "Orb" on the video screen may accumulate points. The colored "Orbs" on one or more of the video screens may switch video screens, encouraging users to move to different locations or place different colored elements into the station near the video screen in order to maximize their score.

Figure 6A:
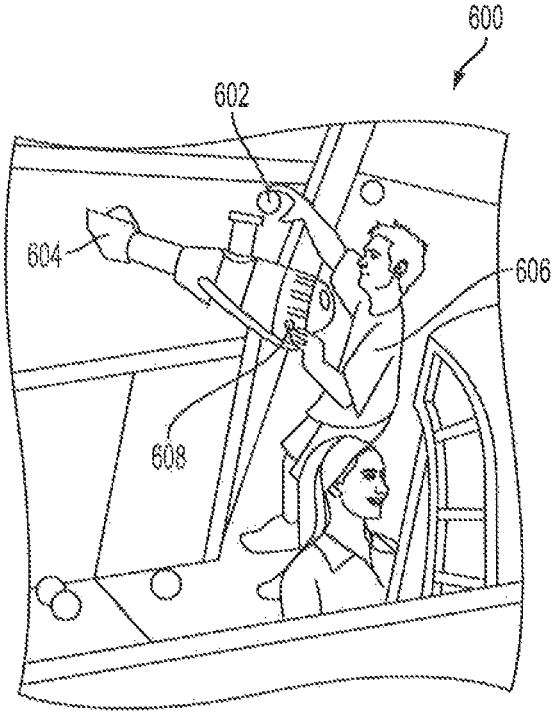
FIG. 6A shows a blaster or cannon component of an interactive play center according to one embodiment of the present invention.

FIG. 6A shows a blaster or cannon component 600. The blaster or cannon component 600 may be located or used in an entertainment venue or interactive play center, for example, the same as or similar to those previously discussed. The blaster or cannon component 600 may receive elements 602 (e.g., foam balls) via a receptacle mounted with the blaster or cannon component 600, or via a receptacle mounted with an adjacent or connected device, and propel those elements out of a barrel 604 of the blaster or cannon component 600 upon activation by a user of a button, switch, or other interactive element 608. In another embodiment, the blaster or cannon component 600 may fire the elements 602 immediately upon their insertion into the blaster or cannon component 600. In still another embodiment, the blaster or cannon component 600 may not fire the elements 602 out of the blaster, but instead use the elements 602 to "charge up" the blaster (e.g., a beam such as a spray of water, light, laser, etc. may be emitted). The blaster or cannon component 600 may operate by permitting a user to insert one element 602 at a time. For example, the blaster or cannon component 600 may be connected with a fountain component (e.g., the fountain component 500, previously discussed) such that elements 602 may be transported from the blaster or cannon component 600 to the fountain component after their insertion by the user 606. Thus, in one embodiment, a blaster or cannon component 600 may not fire the light, laser, etc. until a predetermined number of elements have been inserted within it. In some embodiments, the greater the number of elements inserted into the blaster or cannon component 600 may award different numbers of points upon a successful hit by the laser.

For example, users may fire the elements 602 or light, laser, etc. of the blaster or cannon component 600 at targets or at other users (e.g., wearing targets) to maximize a personal score or accumulation of points. In one embodiment, the elements 602 may be propelled subsequent to their receipt by the blaster or cannon component 600 without requiring additional activation by the user. In another embodiment, the blaster or cannon component 600 may not receive elements during operation (e.g., may be a laser or light gun that does not require elements in order to be "charged up."). In some embodiments, a unit or component configured to shoot a laser or other beam of light may be mounted or otherwise coupled as part of the blaster or cannon component 600. In one example, the laser or other beam of light may not be activated unless a predetermined amount (e.g., three) of the elements 602 (e.g., foam balls) are inserted into the blaster or cannon component 600.

A biometric scanner (e.g., a fingerprint reader) or RFID reader may be disposed as part of each the blaster or cannon component 690 such that the blaster or cannon component or an electronic device connected therewith recognizes a particular user when such user touches or uses the blaster or cannon component 600. In one example, each time the user inserts or shoots an element, a gauge on the blaster or cannon component 600 shows or otherwise indicates (e.g., via visual lights, audio, etc.) that the blaster or cannon component 600 is being energized ranging from a power range of 3 to 10). The greater the blaster or cannon component 600 is energized, the greater the number of points awarded to the user upon a successful action (e.g., hitting a target with an element, hitting another player with an element, etc.). The targets may be any of a variety of targets disposed around the play area of the interactive play center, such as on a center tower, handrails, other columns, or exterior or interior walls, or may be players themselves (e.g., players may wear vests or other wearable devices configured to determine when hit with an element or a laser or beam of light).

Figure 6B:
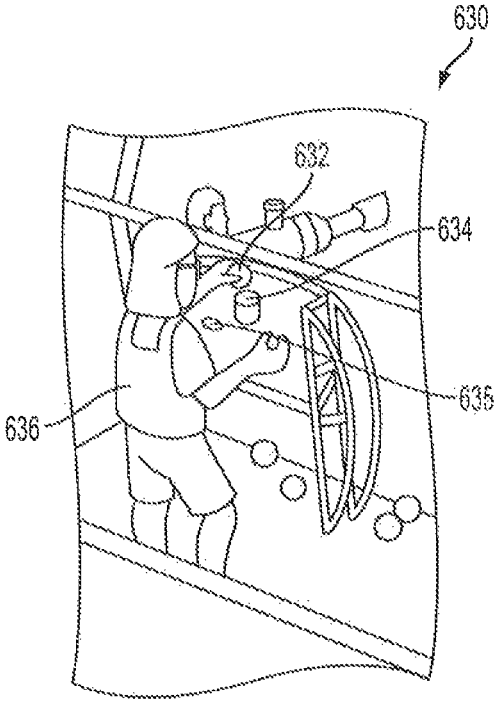
FIG. 6B shows an interactive sorting component of an interactive play center according to one embodiment of the present invention.

FIG. 6B shows an interactive sorting component 630. The sorting component 630 may be located or used in an entertainment venue or interactive play center, for example, the same as or similar to those previously discussed. The sorting component 630 may receive elements 632 (e.g., foam balls) from a user 636 and transfer those elements 632 out of the sorting component 630 and into a transportation tube (e.g., clear or translucent). In one embodiment, similar to described above for FIG. 6A, the interactive sorting component 630 may be connected with a fountain component (e.g., the fountain component 500, previously discussed) such that elements 632 may be transported from the interactive sorting component 630 to the fountain component after their insertion by the user 636.

In one embodiment, points may be accumulated by a user who correctly places a correct color and/or number of elements 632 into the sorting component by way of different receptacles (634, 635). For example, one or more receptacles may be mounted with the sorting component 630 and configured to receive one or more of the elements 632. In one embodiment, certain receptacles may be configured to accept elements 632 having a particular characteristic (e.g., color, shape, visual aesthetic, audible noise, etc.). These characteristics may be determined using any of a variety of manners (e.g., via a sensor within the receptacle, that interfaces with the element 632 inserted therein, such as by way of breaking a beam of light or via communication with an RFID chip mounted within each element 632). For example, when a user places a red-colored element into a red-colored receptacle on the sorting component 630, a processor of interactive play center may accumulate a particular number of points for the user based upon that action. However, if the user places a blue-colored element into a red-colored receptacle on the sorting component 630, the processor of the interactive play center may accumulate a fewer number of points (e.g., zero points) for the user based upon that action. Any of a number of different decisions may be made by the processor in response to the correct or incorrect insertion of an element into a particular receptacle (e.g., a blaster may/may not be charged).

Certain of the elements 632 may be designated as "special elements" (e.g., be different in color, shape, or have other distinguishing characteristics) and placing a special element into a receptacle of an interactive sorting component 630 may award greater number of points than conventional elements. Lower amounts of points may be awarded for use of the interactive sorting component 630 when compared to other devices, components, or activities of the interactive play center due to its relatively simple use. Certain interactive sorting components 630 may award greater points than other interactive sorting components 630 depending on their difficulty of operation (e.g., a greater number of colors that must be matched by users). Users may choose to place elements 632 within the closest interactive sorting component 630 or search out an interactive sorting component 630 that is configured to award greater points. The interactive sorting component 630 may include a biometric scanner (e.g., fingerprint reader or RFID reader) to allow for identification of a specific user when the user touches or otherwise uses the interactive sorting component 630.

Figure 6C:
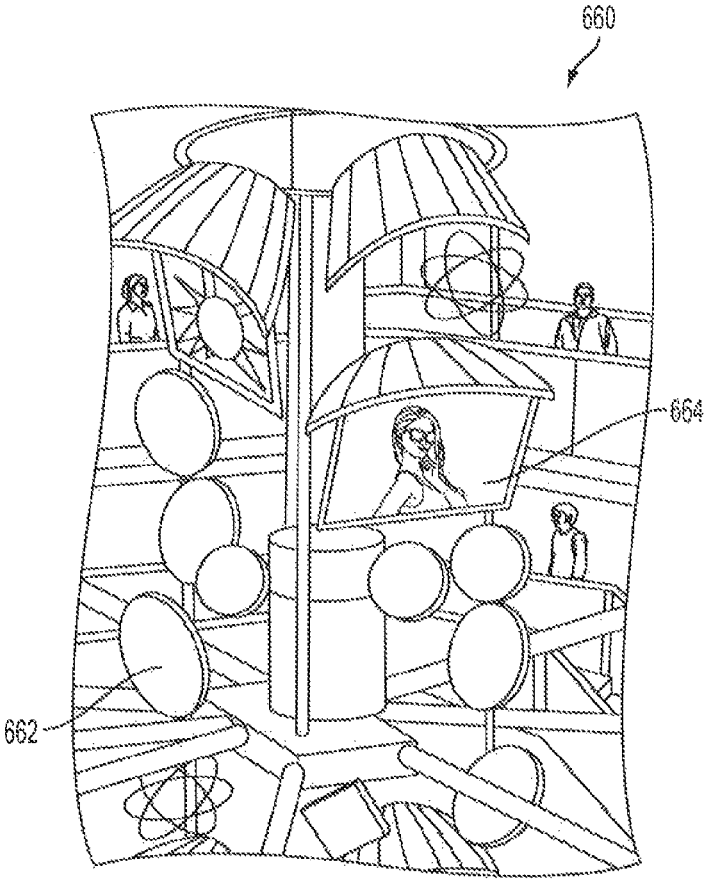
FIG. 6C shows a plurality of entertainment devices of an interactive play center according to one embodiment of the present invention.

FIG. 6C shows a plurality of entertainment devices 660, for example, that may operate in conjunction with the blaster or cannon component 600 previously discussed. For example, targets 662 may be disposed at various locations, such as along a central column (e.g., the fountain component 500) and/or otherwise mounted on walls, handrails, etc. and provide a physical object for users operating an interactive element (e.g., the blaster or cannon component 600) to aim at in order to score points.

One or more of the targets 662 may be stationary targets or may be moving targets (e.g., pendulums or targets upon on a moving track). In some embodiments, a moving target may be put into motion by a user of the interactive play center. Other users may be targets in certain embodiments. In one embodiment, a target may be displayed upon a video monitor that is configured to display and regularly change with a variety of targets that must he hit to award varying amounts of points or hit to prevent a loss of varying amounts of points. In certain embodiments, an electronic or computerized system operating with the interactive play center for calculating points or scores for users may award different points depending upon a user's characteristics. For example, if a user is younger, targets in the vicinity or within hitting distance of the user may be made easier to hit (e.g., larger) or worth greater number of points. If a user is older or more experienced, the targets may be made more difficult to hit. In another example, if a younger user is a target, the awarded points for hitting such younger user may be less for an older or more experienced user.

Video monitors 664 may be disposed at various locations, such as along a central column (e.g., the fountain component 500) and/or otherwise mounted on walls, handrails, etc. and provide a showing to players of portions of the entertainment venue or interactive play center (e.g., camera shots, such as web earn shots, of different locations of the play arena, scoreboard visuals, action scenes of the game being played, etc.). In one embodiment, the video monitors 664 may provide an interactive, or non-interactive, display of the story or background theme of the interactive play center (e.g., to educate or inform a user what activities are available within the interactive play center and/or how to score points).

Cameras may be mounted around the interactive play center (e.g., on a central tower) and face strategic locations (e.g., at cannon or blaster components, such as the cannon or blaster component 600, previously discussed). Either automatically or via control from staff of the interactive play center, the cameras may capture certain users, groups of users, or events and display them on one or more of the video monitors 664. In some embodiments, the cameras may be positioned to capture a particular photo opportunity. In one example, for an interactive play center operating under a story or background theme of energized "Orbs" (see below), a camera may be directed at a particular location where a first user may stand and be operated by a second user to take a picture of the first user, a greater number of floating "Orbs" digitally added to the picture in relation to the number of points the first user has accumulated. This picture may be saved (e.g., for a particular monetary fee) and stored or used by the first user (e.g., as a profile picture for their user account) or displayed upon the video monitors 664.

Automatic image recognition technology, or review by staff of the interactive play center, can prevent offensive photos from being displayed. In certain embodiments, the photo and/or a related journal accounting the user's statistics may be provided or sent to a user. For example, the photo and/or journal can be sent or automatically downloaded to a user's account, sent to the user's phone through a mobile application, and/or printed out at the interactive play center facility. These photos and/or journals may be provided for free or for a fee. In one embodiment, the interactive play center facility, theme park, or other branding may be attached to the photo and/or journal for marketing purposes.

Figure 6D:
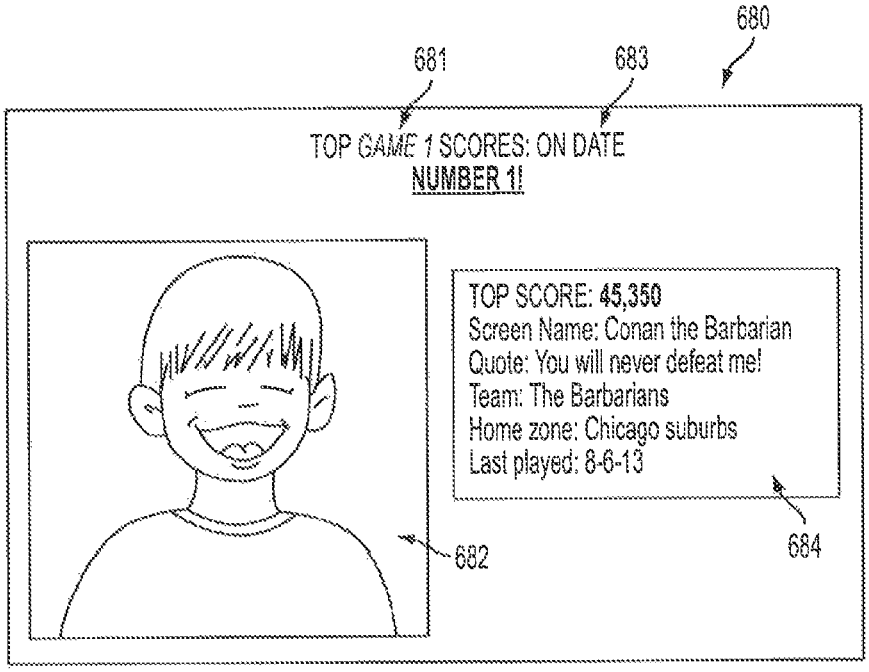
FIG. 6D shows a scoring screen for display in an interactive play center according to one embodiment of the present invention.

FIG. 6D shows an account or score screen 680 for display for a user of an interactive play center. The account or score screen 680 may include features that are the same as or similar to those previously discussed, for example, as a personalization and/or immersion feature of the interactive play center for frequent or high-scoring users. In one embodiment, and as shown, a personalized picture and/or avatar 682 may be chosen by a user for their account. Other statistics 684 may be collected and saved, corresponding to the user account, such as the user's top score, screen name, personalized quote, personalized team, location, date last played, etc. In another embodiment, a user's date 683 where they achieved a top score in a particular game 681 may be displayed on the account score screen 680. Additional or alternative statistics may be saved and/or generated for a user account in other embodiments. The account or score screen 680 may be displayed upon a video screen or other scoreboard of the interactive play center. In an alternative embodiment, the account or score screen 680 may additionally or alternatively be viewable by the user on a mobile device, such as a smart phone or tablet, or viewed upon a web page on the Internet, etc.

Figure 7:
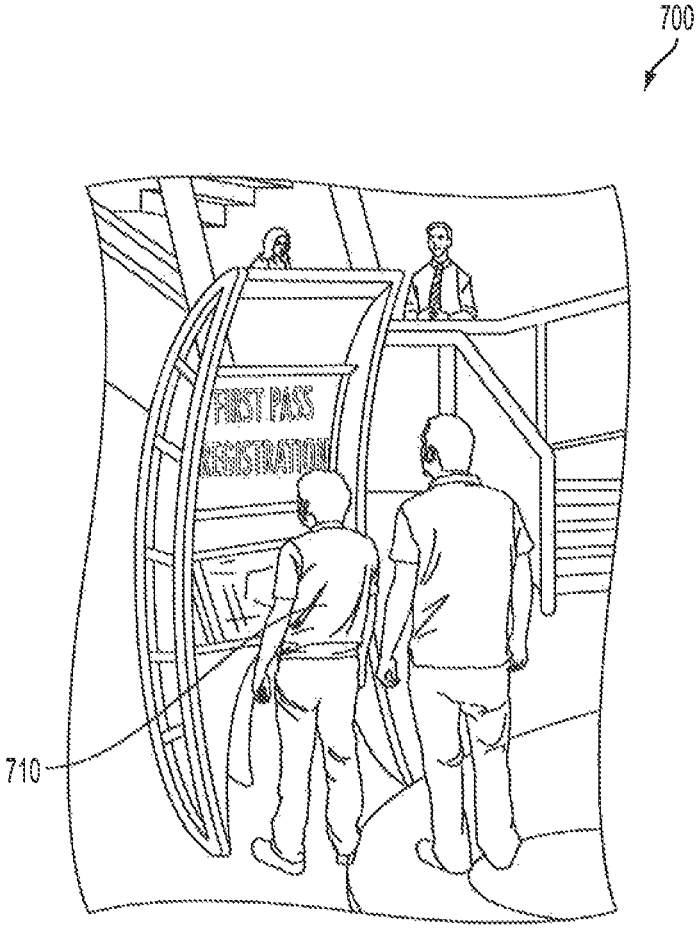
FIG. 7 shows a registration station of an interactive play center according to one embodiment of the present invention.

FIG. 7 shows a registration/upgrade station 700 that may be used as part of an entertainment venue or an interactive play center. The registration/upgrade station 700 and/or entertainment venue or interactive play center may include features that are the same as or similar to those previously discussed. The registration/upgrade station 700 provides a place where users 710 can create or setup a game or profile name for participating in the activities of the interactive play center. Users 710 may be tracked biometrically or with RFID tags (e.g., that are worn by the user) in order to track their activities for the generation or loss of points and to determine user statistics. Any of a variety of tracking methods may be used in different embodiments, including fingerprint recognition, retinal scanning, RFID, etc.

Figure 8A:
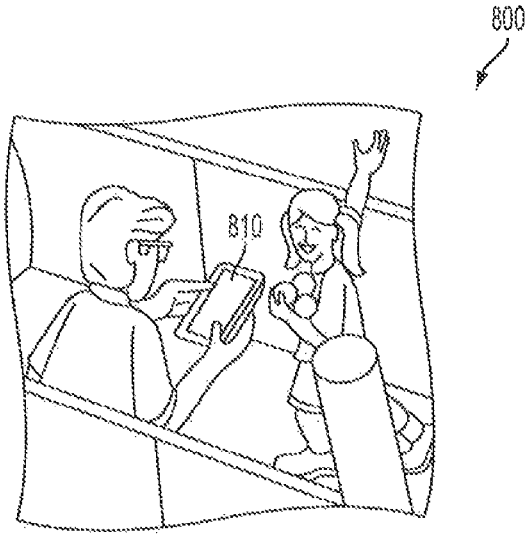
FIG. 8A shows a mobile application related to an interactive play center according to one embodiment of the present invention.
Figure 8B:
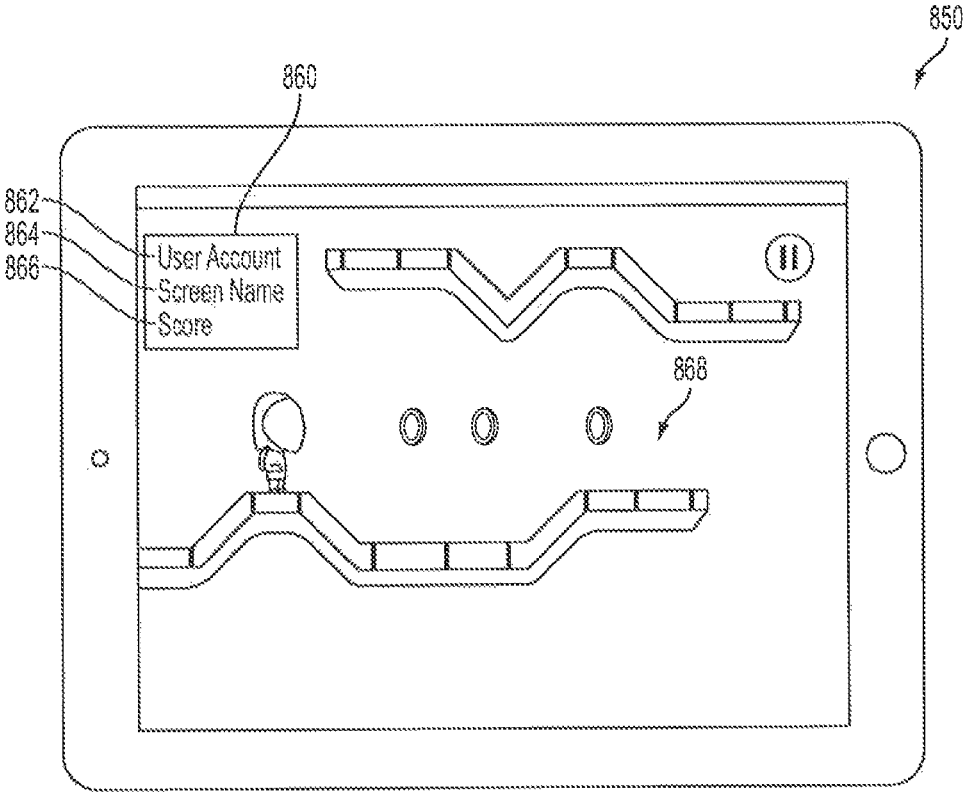
FIG. 8B shows a display screen of a mobile application related to an interactive play center according to one embodiment of the present invention.

FIGS. 8A-8B shows the use 800 of a mobile application 810 related to an interactive play center. The mobile application 810 and/or the interactive play center may include features that are the same as or similar to those previously discussed. In one example, once a user has registered for a game at an amusement location or play center, the user can log on to the mobile application 810 during play at the amusement location and/or at a later time or download and install the mobile application 810 on their smartphone, tablet, or other electronic device and continue to learn more or interact with the story or background theme of the interactive play center. For example, the mobile application 810 may be a software application that can be downloaded to smartphones or tablets and display story information or game action information that users can read to learn more about the activities that can be performed at the interactive play center.

In one embodiment, data may be included in the mobile application that can provide additional information to guide users to certain locations or activities at the interactive play center in order to generate bonus points. For example, the mobile application may include an augmented reality overlay onto the play area structure of the interactive play center and identifies where bonus points can be found. Thus, a device held or otherwise carried by a user may allow for increased functionality in terms of interacting with one or more of the activities of the interactive play center. For example, such a device may be tracked by (e.g., via any of the various methods discussed, such as by GPS functionality of the mobile device, etc.) such that a processor of the interactive play center or mobile application may determine where the user is located and/or what activities the user has been involved in. In addition to using this data for generation of a score or other statistics, additional game opportunities or functionality may be presented to the user via the device and/or mobile application.

For example, the mobile application may also contain additional quests or missions that a user, either alone, or in conjunction with other users (e.g., family members) can work together to obtain additional points. Such information may not be readily available to other users that do not have the mobile application in order to incentivize as many users to download the application as possible. The secret locations for bonus points may be updated at regular intervals in both the interactive play center and the mobile application to ensure the information remains protected. For example, in one embodiment, particular activities (e.g., sorting components, blaster components, etc.) that are considered "special" and/or that award extra points may be identified by the device and/or mobile application (such as by showing a picture of the special activity, identifying the special activity by location (e.g., GPS coordinates), visually indicating special activities or areas by viewing a screen or display of the device that acts as an augmented reality, etc.

FIG. 8B shows a display screen of a mobile application related to an interactive play center. The mobile application and/or the interactive play center may include features that are the same as or similar to those previously discussed. The display screen may be a part of a take-home game experience so that users can continue to experience the entertainment of the interactive play center after they have returned home. Such continued presence in the form of a game or other entertaining activity encourages users to become immersed in the brand of the interactive play center. Various statistics 860 for a user may carry over from their participation at the amusement location or interactive play center, for example, user account 862, screen name 864, and/or score 866.

Orbs Story or Background Embodiment

A story or background information may be accessible by users of an interactive play Center. The story or background information may provide a more immersive or fun experience to the user and/or provide a context for the various games or activities located within the interactive play center. The interactive play center may include features that are the same as or similar to those previously discussed. In one embodiment, the story or background information may focus upon a theme of electron orbs, as discussed below.

The interactive play center may he described as a fusion of technologies (a Fusion Factory), old and new, that come together in a playground for both the electrons that power various devices and the people who use them. History suggests that these playful electrons were first captured and used by Nikola Tesla, a little known inventor in the time of Thomas Edison who actually bested Edison in many ways with his inventions. They survive today in the Fusion Factory where all of his ideas and technology come alive as they keep growing and changing, powered by the very AC current electricity that he developed in 1887.

The key to harnessing these electrons is through their parent source, balls of concentrated energy called "Orbs". "Orbs" have many purposes and functions. Tesla was the first to understand that they were sentient beings that he could befriend and use to accelerate and support his work. These "Orbs" constantly need power to keep themselves and the Fusion Factory running. Colored energy power balls are the source of this power. Users can assist the "Orbs" and give them more power by gathering and inserting the power balls at specific locations throughout the Fusion Factory. However, they are dark powers that are out to stop the "Orbs" and eliminate their ability to influence and modernize the world all around us. A few "Orbs" have become agents of those dark powers and must be stopped.

Users are encouraged to become an "Orb Master" by assisting them in keeping the factory running while deterring or destroying the dark powers whenever they appear to make mischief. Users can score points each time they help an "Orb." Users can lose points when a dark "Orb" succeeds in its mission to shut part of the Fusion Factory down. It is up to the users to continue the work that Tesla began over a century ago by using the very devices he invented, including lasers, ball blasters, x-rays, phones, cameras, wireless communications, other interactive devices, etc. The story of the "Orbs" may be told via video screens, touchscreens, and/or mobile devices located throughout the facility or in the possession of the users (e.g., as a downloadable application or video). The "Orbs" may ask for a user's help in energizing the Fusion Factory via placing power pellets (e.g., foam balls) into certain collection bins, buckets, blasters, and/or baskets. A user may earn points by assisting the different energy "Orbs," each "Orb" associated with a different color that corresponds to the colors of foam balls. A user may also energize blasters with balls in order to blast the dark "Orbs" and keep them from taking over the Fusion Factory.

The previously discussed embodiments for an entertainment venue or interactive play center including a variety of activities for users may be controlled or maintained by a system including a server and a back-up server in the case of power failure. The servers may be connected to an online network work Cloud system with a corresponding tech support team that is capable of remotely monitoring the system. The entertainment venue or interactive play center may be an indoor or an outdoor play system. Any of a variety of stories or background themes may be setup for the entertainment venue or interactive play center. In certain embodiments, a "night": version of the interactive play center 100 may he provided, where ultraviolet lights and/or laser play is combined for a darkened arena, yet still visible enough for play.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An interactive play center comprising:

a receptacle configured to receive an element;

a blaster component configured to emit an object based upon receipt of the element by the receptacle;

a target configured to be engaged by the object emitted from the blaster component; and a fountain component having a column with a cavity disposed therein, the fountain component in communication with the receptacle and configured to receive the element and eject the element out of the fountain component such that the element falls at an undetermined location within the interactactive play center.

2. The interactive play center of claim 1 wherein the receptacle is coupled with the blaster component.

3. The interactive play center of claim 1 wherein the receptacle is coupled with a sorting component separate from the blaster component.

4. The interactive play center of claim 1 wherein the object is a beam of light, a laser beam, a stream of water, or the element received by the receptacle.

5. The interactive play center of claim 1 wherein the element is a ball.

6. The interactive play center of claim 5 wherein the ball is made of plastic or foam.

7. The interactive play center of claim 1 wherein the fountain component is configured to receive the element in the cavity and eject the element from the cavity via pressurized air.

8. The interactive play center of claim 7 wherein the column of the fountain component is at least partially transparent.

9. An interactive play center comprising:

a first receptacle configured to receive an element, the first receptacle associated with a first characteristic;

a second receptacle configured to receive the element, the second receptacle associated with a second characteristic;

a blaster component configured to emit an object based upon receipt of the element by the first receptacle or the second receptacle;

an expelling component having a vertical column,the expelling component configured to receive the element and expel the element out of the column such that the element falls at an unpredictable location within the interactive play center;

a target configured to be engaged by the object emitted from. the blaster component; and a processor configured to modify a score if the object engages the target.

10. The interactive play center of claim 9 wherein the first characteristic is a first color and the second characteristic is a second color different from the first color.

11. The interactive play center of claim 9 wherein the target is configured to be worn by a user.

12. The interactive play center of claim 9 wherein the processor is further configured to modify the score based upon receipt of the element by the first receptacle.

13. The interactive play center of claim 9 wherein the blaster component is configured to emit the object if the element has the first characteristic and is received by the first receptacle, but not emit the object if the element has the second characteristic and is received by the first receptacle.

14. The interactive play center of claim 9 wherein the processor is further configured to increase the score if the element has the first characteristic and is received by the first receptacle, but not increase the score if the element has the second characteristic and is received by the first receptacle.

15. An interactive play center comprising:

a receptacle configured to receive an element;

a first interactive component disposed at a first location;

a second interactive component disposed at a second location;

a fountain component having a column configured to receive the element after receipt of the element by the receptacle, the fountain component configured to eject the element upwardly out of the column via pressurized air such that the element drops due to gravity toward a location within the interactive play center; and a processor configured to increase a score by a first value based upon interaction with the first interactive component and increase the score by a second value based upon interaction with the second interactive component.

16. The interactive play center of claim 15 wherein the first interactive component or the second interactive component is a blaster component configured to emit an object.

17. The interactive play center of claim 15 wherein the first interactive component or the second interactive component is a sorting component, the sorting component coupled with the receptacle.

18. The interactive play center of claim 15 further comprising a software application configured to be installed on a mobile device, the software application configured to indicate if the first interactive component will accumulate a greater number of points if used compared to the second interactive component.

19. The interactive play center of claim 15 further comprising a display coupled with the processor, the display configured to convey the score based upon interfacing with the processor.

20. The interactive play center of claim 19 wherein the display is further configured to convey if the first value is higher than the second value based upon interfacing with the processor.

* * * * *